US008316588B2

(12) United States Patent
Cicognani

(10) Patent No.: US 8,316,588 B2
(45) Date of Patent: Nov. 27, 2012

(54) RIG FOR DRILLING OR MAINTAINING OIL WELLS

(75) Inventor: Claudio Cicognani, Cesena (IT)

(73) Assignee: Drillmec S.p.A., Gariga di Podenzano (PC) (IT)

( * ) Notice: Subject to any disclaimer, the term of this patent is extended or adjusted under 35 U.S.C. 154(b) by 398 days.

(21) Appl. No.: 12/100,182

(22) Filed: Apr. 9, 2008

(65) Prior Publication Data

US 2008/0251267 A1 Oct. 16, 2008

(30) Foreign Application Priority Data

Apr. 13, 2007 (IT) ..... TO2007A0257

(51) Int. Cl.
*E21B 15/00* (2006.01)
*B66C 21/10* (2006.01)

(52) U.S. Cl. ..... 52/118; 52/143

(58) Field of Classification Search ..... 52/117, 52/118, 116, 143; 166/77.3, 379; 212/301, 212/306, 175, 177, 294, 302–305; 414/332, 414/919; 29/11, 434, 525.01
See application file for complete search history.

(56) References Cited

U.S. PATENT DOCUMENTS 3,136,394 A * 6/1964 Woolslayer et al. ..... 52/120
3,228,151 A * 1/1966 Woolslayer et al. ..... 52/64
3,719,238 A * 3/1973 Campbell et al. ..... 175/122
3,803,780 A * 4/1974 Donnally ..... 52/116
3,912,088 A * 10/1975 Bronfman ..... 212/274
3,942,593 A * 3/1976 Reeve et al. ..... 173/186
3,960,360 A * 6/1976 Elliston ..... 166/77.4
4,138,805 A * 2/1979 Patterson ..... 52/118
4,269,395 A * 5/1981 Newman et al. ..... 254/386
4,290,495 A * 9/1981 Elliston ..... 52/115
4,371,046 A * 2/1983 Read ..... 175/57
4,537,317 A * 8/1985 Jensen ..... 212/301
4,706,825 A * 11/1987 Johnson ..... 212/294
4,759,414 A * 7/1988 Willis ..... 175/170
5,248,005 A * 9/1993 Mochizuki ..... 175/85
5,269,107 A * 12/1993 Klemm ..... 52/115
6,634,436 B1 * 10/2003 Desai ..... 173/1
6,719,062 B2 * 4/2004 Fikes et al. ..... 166/379
7,461,831 B2 * 12/2008 Mosley ..... 254/277
7,765,749 B2 * 8/2010 Palidis ..... 52/112

* cited by examiner

*Primary Examiner* — Brian Glessner
*Assistant Examiner* — Joseph J Sadlon
(74) *Attorney, Agent, or Firm* — Merchant & Gould P.C.

(57) ABSTRACT

A Rig (1) for drilling or maintaining oil wells includes a base structure (2) which is provided with a support platform (3) on the ground and a raised work platform (5). A deck (6) is co-planar to and integral with the support platform (3) and is suitable for housing a trailer (7). A telescopic antenna (8) is provided with two fixing eyelets (9) which are arranged at the lower end of the telescopic antenna (8) in order to be hinged to the work platform (5). A lifting device (10) is suitable for lifting the telescopic antenna (8) from a transport position, in which it reposes on a transporter (7) with the two fixing eyelets (9) at a lower level than the level of the work platform (5), to a working position, in which it is vertically arranged on the work platform (5) with the fixing eyelets (9) hinged to the work platform (5). The lifting device (10) is provided with a moving articulated parallelogram structure provided with at least two rocker arms (11) hinged to the telescopic antenna (8) and which are hingeable to the deck (6), and with at least one linear actuator (12) with a variable thrust head which may be interposed between the telescopic antenna (8) and the deck (6) to activate the moving structure (10') and lift the telescopic antenna (8).

12 Claims, 5 Drawing Sheets

RIG FOR DRILLING OR MAINTAINING OIL WELLS

BACKGROUND OF THE INVENTION

The present invention relates to a rig for drilling or maintaining oil wells.

In recent years, in the field of drilling oil wells, there has been a more pressing need for rigs for the drilling or maintenance of oil wells themselves which present structures of easy and simple assembly and dis-assembly in relation to the oil wells in such a way as to maximise the production times of drilling and to minimise the non-productive times relating to erection and disassembly.

The American patent No. U.S. Pat. No. 3,942,593 makes known a drilling rig for oil wells which comprises:

- a base structure which comprises a support platform on the ground and a raised work platform;
- a deck which is co-planar to and integral with the support platform which is suitable for housing a trailer;
- a telescopic antenna which is provided with two fixing pins which are arranged at the lower ends of the telescopic antenna itself in order to be engaged on the work platform; and
- a lifting device which is suitable for lifting the telescopic antenna from a transport position, in which it reposes on the trailer with the two fixing pins at a level which is lower than the level of the work platform, to a working position, in which it is vertically arranged on the work platform and in which the fixing pins are engaged in respective hinges.

The lifting device comprises:

- two cable linkages, which are suitable for being connected to the lower ends of the telescopic antenna, and which are activated opposite the work platform in relation to the telescopic antenna itself in order to unite the fixing pins with the relative hinges; and
- two hydraulic pistons, which are interposed between the telescopic antenna and the deck, and which are suitable for being elongated in order to rotate the telescopic antenna around the respective pins in such a way as to lift the telescopic antenna itself into its working position.

The rig which is described in the above-mentioned American patent presents some limitations which are due both to the use of the cable linkages, which require considerable power in order to drag and lift the telescopic antenna as far as to make the fixing pins reach the hinges on the work platform, as well as the hydraulic pistons, the elongation and lifting capacities of which are such as to require structures of considerable dimensions.

SUMMARY OF THE INVENTION

The aim of the present invention is to produce a rig for the drilling and maintenance of oil wells, which will be devoid of the above-described disadvantages.

According to the present invention, a rig for the drilling and maintenance of oil wells will be produced, comprising:

- a base structure which is provided with a support platform on the ground and with a raised work platform;
- a deck which is co-planar to and integral with the support platform and which is suitable for housing transport means;
- a telescopic antenna which is provided with two fixing eyelets which are arranged at the lower end of the telescopic antenna itself in order to be hinged onto the work platform; and

- a lifting device which is suitable for lifting the telescopic antenna from a transport position, in which it reposes on the transport means with the two fixing eyelets at a lower level than the level of the work platform, and a working position, it which it is vertically arranged on the work platform with the fixing eyelets hinged to the work platform itself;

the rig being characterised by the fact that the lifting device comprises a moving structure of the articulated parallelogram kind and which is provided with at least two rocker arms which are hinged to the telescopic antenna and which are hingeable to the deck and at least one linear actuator with a variable thrust head which may be interposed between the telescopic antenna and the deck in order to activate the moving structure and lift the telescopic antenna.

BRIEF DESCRIPTION OF THE DRAWINGS

The present invention will now be described with reference to the attached drawings, which illustrate a non-limiting form of embodiment of the present invention, and in which.

Figure 1:
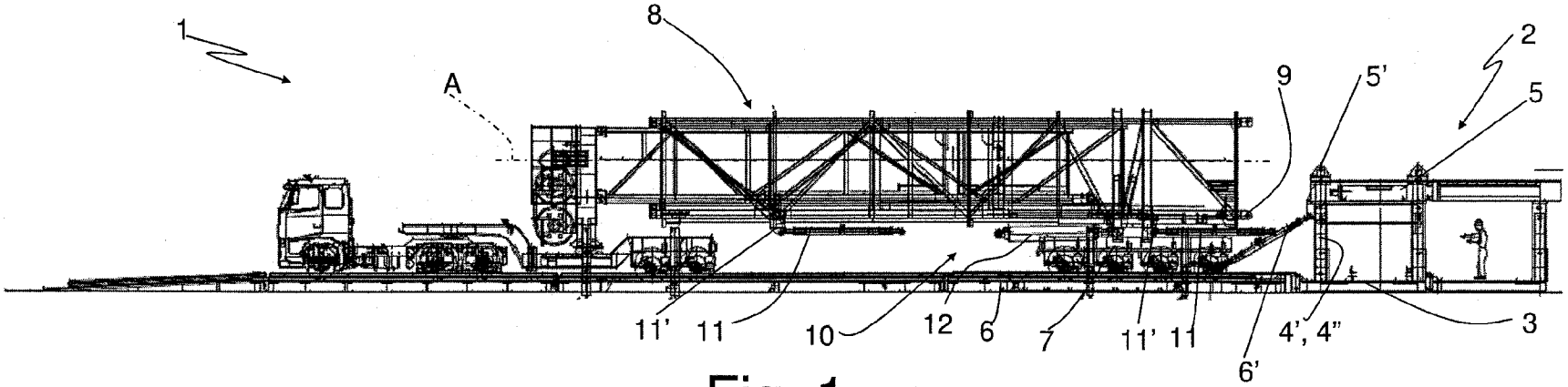
FIG. 1 is a lateral elevation view of a preferred form of embodiment of a rig for the drilling or maintenance of oil wells in an operative configuration at the beginning of assembly in accordance with the present invention.

FIGS. from 4 to 9 illustrate, in lateral elevation, respective assembly stages of the rig which is shown in FIG. 1.

DETAILED DESCRIPTION OF THE PREFERRED EMBODIMENTS

With reference to the attached drawings, the number 1 indicates, in its entirety, a rig for the drilling or maintenance of oil wells.

The rig 1 comprises a base structure 2 which is provided with a support platform 3 on the ground, with a number of hydraulic cylinders 4' and telescopic legs 4" which are arranged on the platform 3, and with a work platform 5 which is supported by the legs 4" in a position which is raised in relation to the support platform 3 and parallel to the support platform 3 itself.

In addition, the rig 1 comprises a deck 6 which is co-planar to and integral with the support platform 3 and which is suitable for housing at least one trailer 7, and a telescopic antenna 8 which may be transported on one or more trailers 7 in a closed configuration and provided with two fixing eyelets 9 which are arranged at the lower ends of the telescopic antenna 8 itself in order to be hinged in correspondence with additional eyelets 5' which are arranged on the work platform 5.

The antenna 8 is carried by means of the trailer 7 onto the deck 6 in a transport position, in which it reposes on the trailer 7 itself with its own axis A substantially horizontal, and with the fixing eyelets 9 arranged at a level which is lower than the level of the eyelets 5' of the work platform 5.

Finally, the rig 1 comprises a lifting device 10, which is suitable for lifting the telescopic antenna 8 from the transport position to a working position, in which it is vertically arranged on the work platform 5 with the fixing eyelets 9 hinged to the eyelets 5', and comprises a moving structure 10' of the articulated parallelogram kind, in which the deck 6 defines the frame while the telescopic antenna 8 defines the rod, and which is provided, for each side of the antenna 8, with two rocker arms 11, which are hinged to the antenna 8 itself in correspondence with respective hinges 11', and which may be hinged to the deck 6 at a distance from each other which is equal to the axial distance between the hinges 11'.

In addition, the lifting device 10 comprises a hydraulic cylinder 12, which is hinged to the antenna 8 at a determined axial distance D from the eyelets 9, and is suitable for also being hinged at two distinct points P1 and P2 along the deck 6 in order to vary, as is better described below, the thrust head of the cylinder 12. According to necessity, the device 10 may also comprise two cylinders 12 which are arranged on respective sides of the antenna 8.

Finally, the lifting device 10 comprises a holding trestle 13, which is mounted on the deck 6 and which may be interposed between an upper portion 14 of the telescopic antenna 8 and the deck 6 itself in order to temporarily support the antenna 8 in a regulating position for a working height of the fixing eyelets 9 and the relative work platform 5.

The installation of the drilling rig which has been described above foresees a first stage of placement by means of barbed connections of the base structure 2 and of the deck 6 on the ground, in such a way that the deck 6 is co-planar to the support platform 3 and by precisely regulating the length of the legs 4" in such a way that the work platform 5 is perfectly even.

So, as is shown in FIG. 1, inside the deck 6, are placed both the trestle 13, which will subsequently be used to support the antenna 8 during the lifting stage, as well as a lifting jack (which is not illustrated) for moving the thrust head of the lifting cylinder 12.

Once these preliminary operations have been carried out, the antenna 8, which is arranged in its own collapsed transport configuration, is positioned on the deck 6 by means of the trailer 7 (FIG. 1) and, subsequently, the trolleys with the respecting parking jacks are also positioned in order to level the antenna 8 in such a way that its respective axis A is perfectly horizontal, and with the relative fixing eyelets 9 at a level which is lower than the level of the work platform 5.

Figure 4:
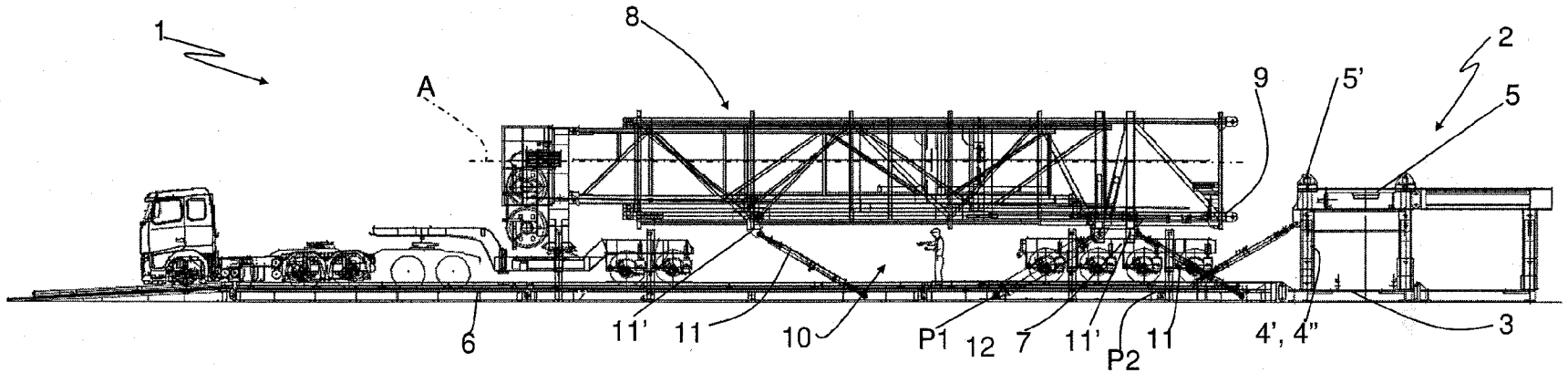

So, as is shown in FIG. 4, the two rocker arms 11, which also present a length which may be regulated, are hinged to the deck 6 at a distance one from the other which is equal to the axial distance between the hinges 11' in such a way as to form with the deck 6 itself and the antenna 8 the moving structure 10' of the articulated parallelogram kind, in which the lengths of the two rocker arms 11 are equal to each other.

In the same way as the anchoring of the rocker arms 11, the cylinder 12 is also anchored at the point P1 which is arranged in a more remote position than the point P2 in relation to the structure 2.

Figure 5:
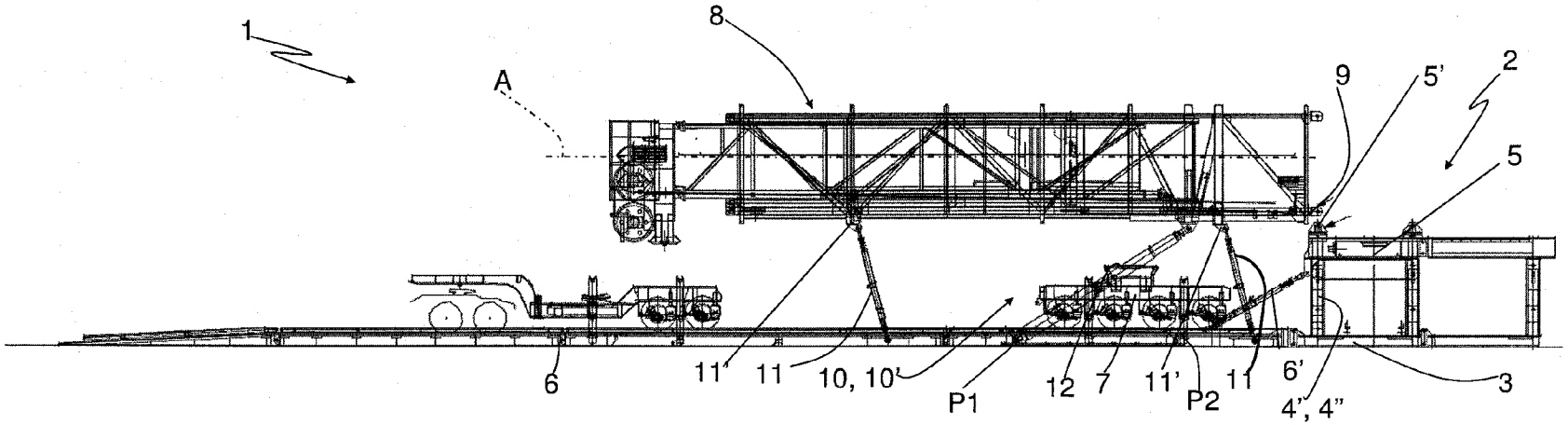
Figure 6:
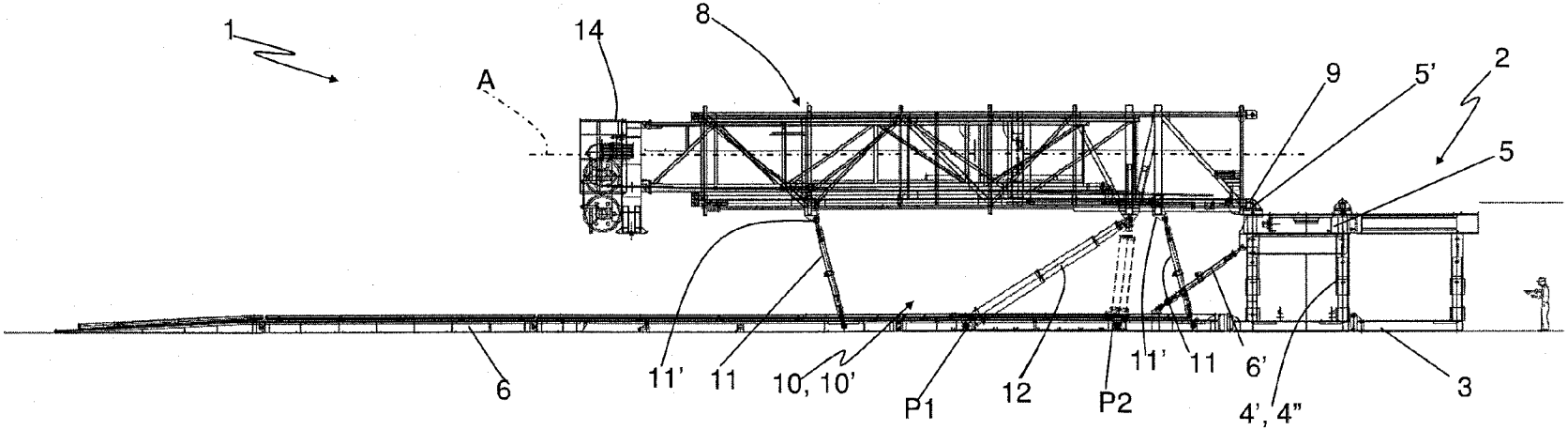

Once the structure 10' has been closed, the cylinder 12 is activated in order to determine the lifting of the antenna 8 parallel to itself, as is shown in FIG. 5, as far as to obtain the vertical alignment of the eyelets 9 with the eyelets 5', which will be conjoined with the eyelets 9 by lifting the work platform 5 by means of the cylinders 4' as is shown in FIG. 6, and will be hinged to the eyelets 9 themselves so as to form a rotation axis B for the antenna 8 transverse to the axis A.

Figure 7:
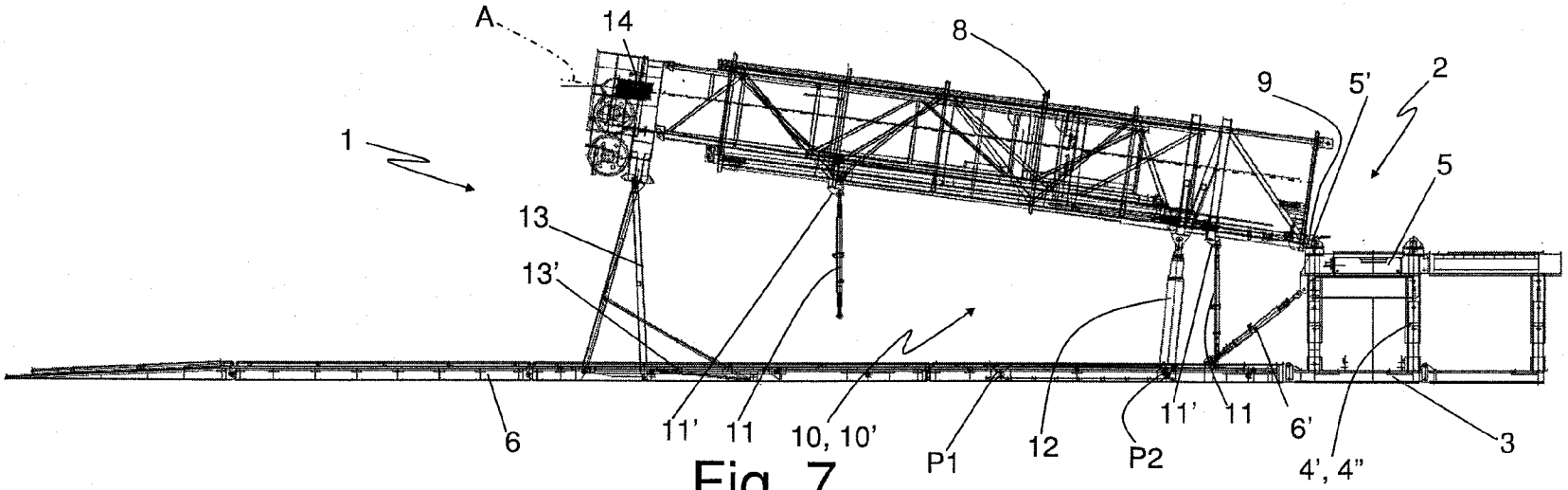

Once the eyelets 9 have been fixed to the eyelets 5', or rather once the antenna 8 has been connected to the structure 2, and once the structure 2 has been fixed to the deck 6 by means of an arm 6', the thrust head of the cylinder 12 is translated from P1 to P2 by means of a lifting jack which is mounted inside the deck also determining a reduction in length of the cylinder 12 itself. So, once all the rocker arms 11 have been liberated from the deck 6, the cylinder 12 is activated, as is shown in FIG. 7, by a first partial rotation of the antenna 8 around the axis B in such a way as to lift the upper portion 14 of the antenna 8 to a level which corresponds to the effective level of the work platform 5.

Figure 8:
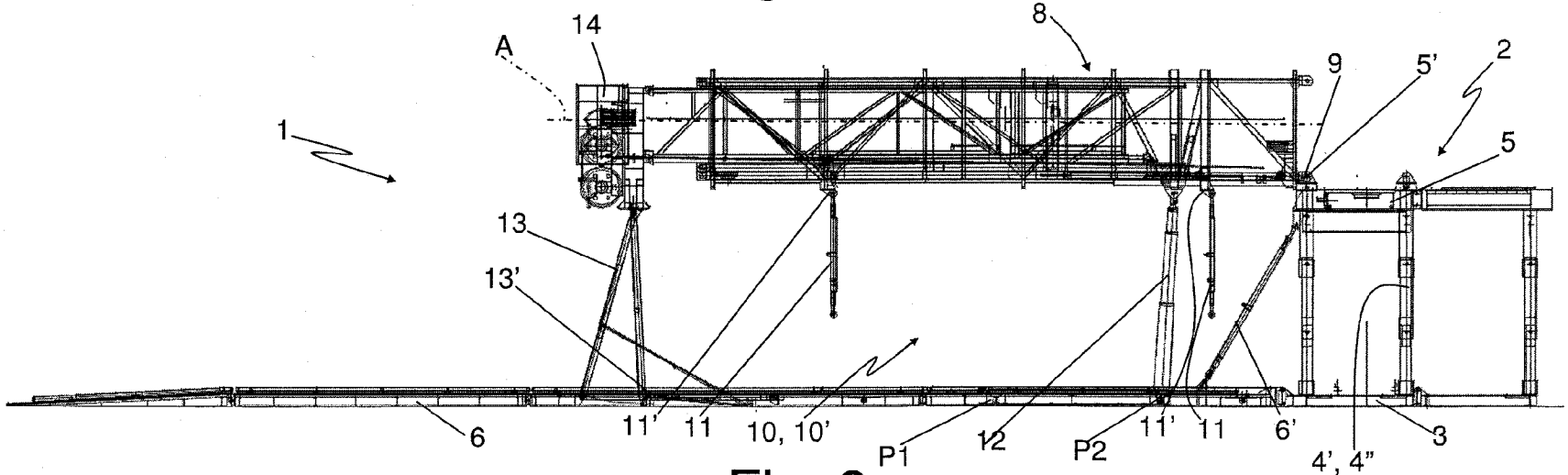

At this point the trestle 13 is lifted by means of a lifting jack 13' as far as to meet the portion 14 in order to block the portion 14 itself and the platform 5 is lifted, as is shown in FIG. 8, by means of the cylinders 4' and the legs 4" into its own working position determining a new levelling of the antenna 8.

Figure 9:
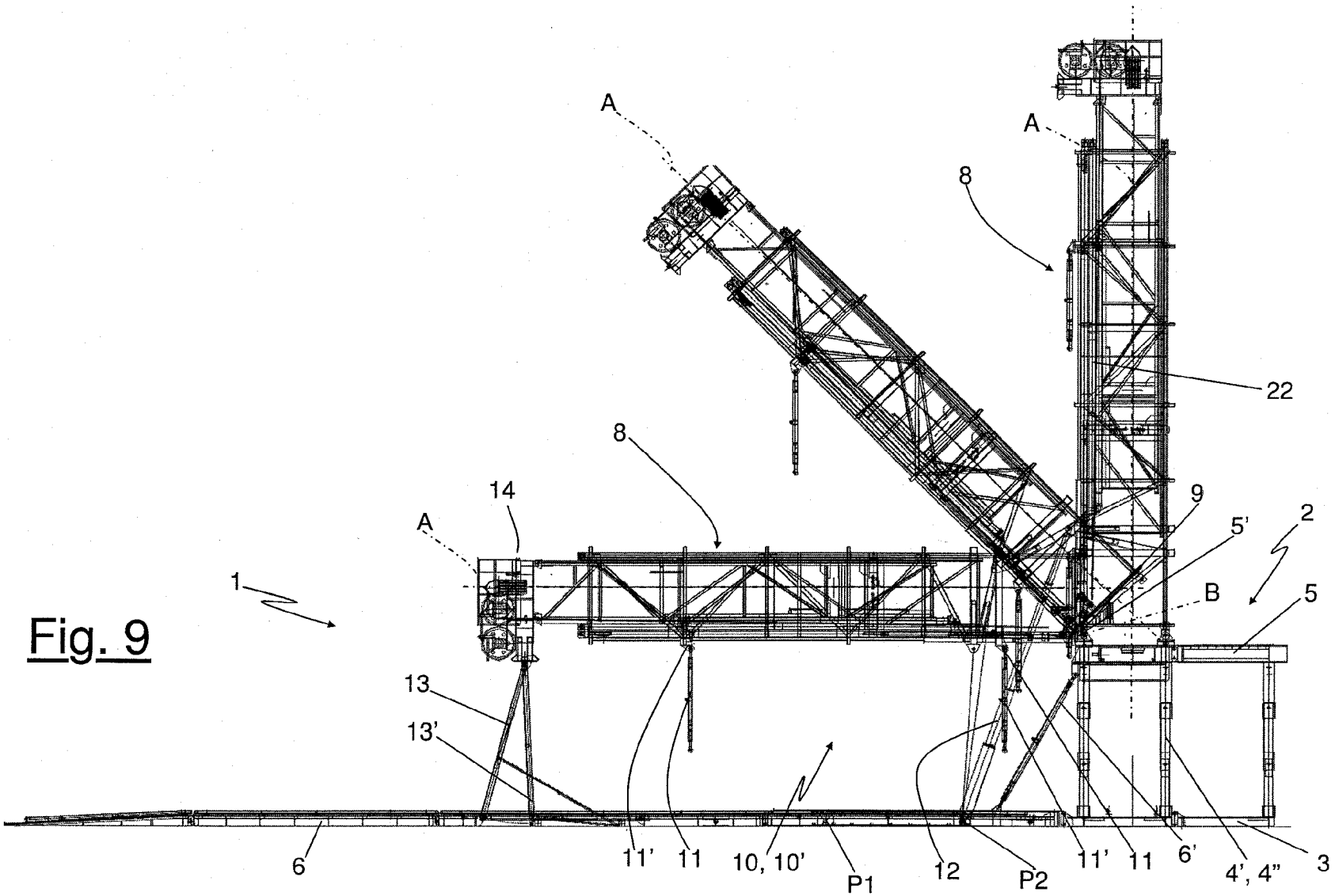

Once the antenna 8 has been levelled, it is sufficient to unhook the trestle 13 and elongate the cylinder 12 as far as the complete positioning of the antenna 8 in its working position by means of a rotation of 90° around the axis B as is shown in FIG. 9.

Figure 2:
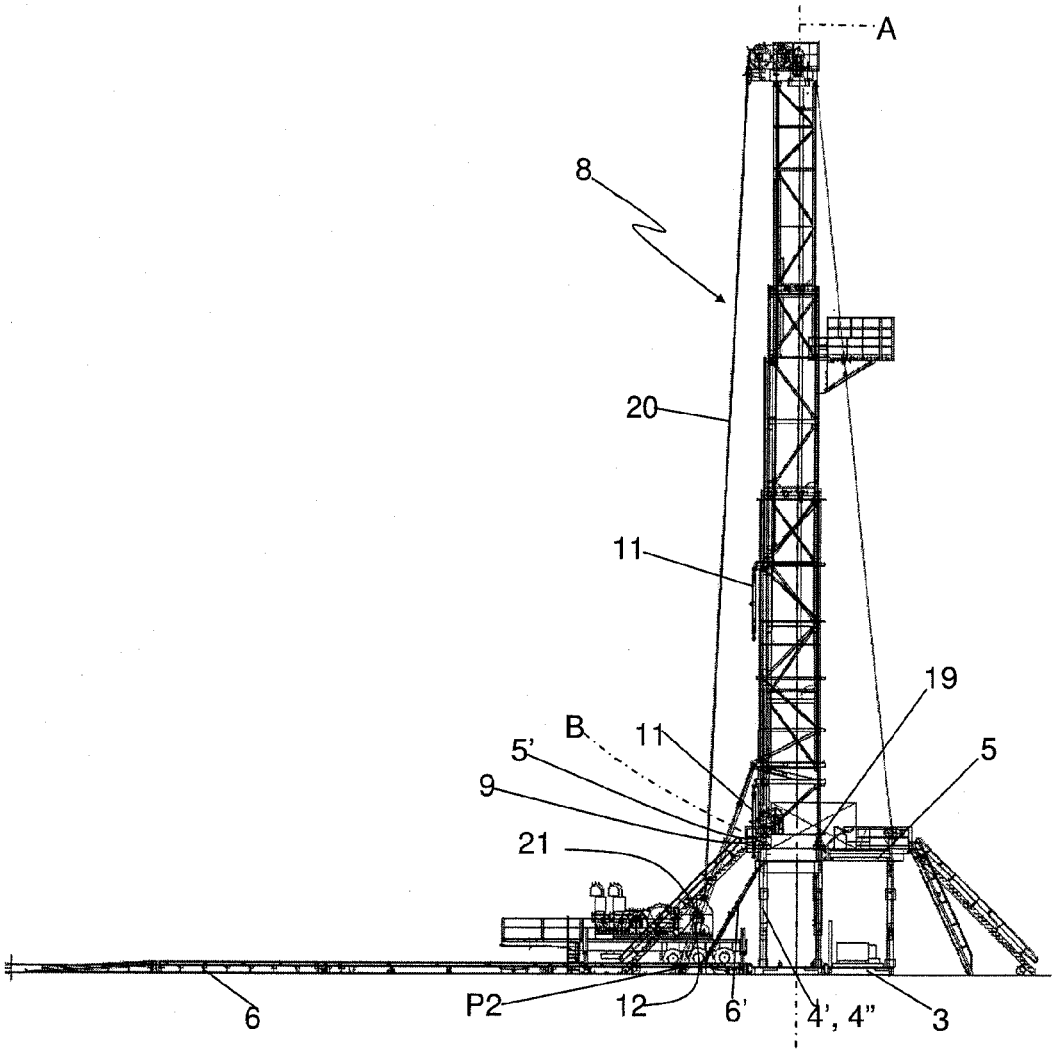
FIG. 2 is a lateral elevation view of the rig which is shown in FIG. 1 in an operative configuration at the end of assembly.
Figure 3:
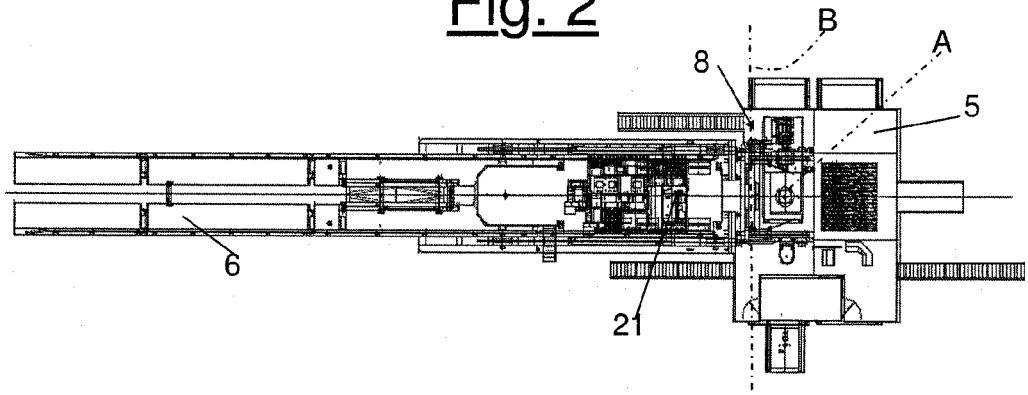
FIG. 3 is a plan view of the rig which is shown in FIG. 2.

The antenna 8, which is by now arranged in a vertical position, is completely anchored to the work platform 5 by means of the fixing eyelets 9 is connected to a lifting cable 20 coming from an which 21 (FIG. 2) which has been arranged on the deck 6 in the meantime 6, and is unfurled as far as its complete extension along the axis A by means of a lifting hydraulic cylinder 22 which is positioned inside the antenna 8 itself.

The disassembly of the rig 1 takes place by following the above-described stages in reverse order.

It is obvious from the foregoing description that the rig 1 and its method of assembly and disassembly offer several advantages consisting in a greater speed of installation of the rig 1 itself, in the fact that the antenna 8 may be transported in its collapsed position in a single load, in the possibility of regulating the height of the base structure 2 above all during assembly thus permitting greater reliability and precision in terms of levelling.

The invention claimed is:

1. A rig for drilling or maintaining oil wells comprising:

a base structure with a support platform on the ground and a raised work platform;

a deck co-planar to and integral with the support platform and which is suitable for housing transport means;

a telescopic antenna provided with two fixing eyelets arranged at the lower end of the telescopic antenna to be hinged onto the work platform; and a lifting device suitable for lifting the telescopic antenna from a transport position, wherein the telescopic antenna is positioned on the transport means with the two fixing eyelets at a lower level than the level of the work platform, and a working position, wherein the telescopic antenna is vertically arranged on the work platform with the fixing eyelets hinged to the work platform;

wherein the lifting device comprises a moving articulated structure having at least two rocker arms hinged to the telescopic antenna and which are hingedly mounted to the deck, wherein a first one of the rocker arms is hinged to the telescopic antenna at a first hinge and is mounted to the deck at a second hinge and a second one of the rocker arms is hinged to the telescopic antenna at a third hinge and is mounted to the deck at a fourth hinge, wherein the rocker arms have an equal length and are parallel, and wherein the distance between the first hinge and the third hinge and the distance between the second hinge and the fourth hinge are equal, and wherein at least one linear actuator with a variable thrust head is interposable between the telescopic antenna and the deck to oscillate the rocker arms and to lift the telescopic antenna.

2. The rig according to claim 1, wherein the lifting device comprises a holding trestle mounted on the deck and which may be interposed between an upper portion of the telescopic antenna and the deck to temporarily support the telescopic antenna in a regulating position of a working height of the fixing eyelets and the work platform.

3. The rig according to claim 2, comprising a plurality of hydraulic cylinders and telescopic legs interposed between the support platform and the work platform to lift the work platform into a working position of a connecting position, in correspondence with which the fixing eyelets of the telescopic antenna are connected to the work platform.

4. The rig according to claim 3, comprising a lifting cylinder arranged inside the telescopic antenna to extend the telescopic antenna along a relative axis.

5. The rig according to claim 1, wherein the rocker arms are configured so that rotation of the rocker arms lifts the telescopic antenna to maintain an axis of the antenna parallel to the support platform.

6. The rig according to claim 1, wherein the at least two rocker arms mount to a first side of the antenna.

7. A method for installing a rig for drilling or maintaining oil wells, the method comprising the following stages:

positioning a telescopic antenna comprising at least an upper portion and a lower portion in a closed configuration on a deck which is co-planar to and integral with a support platform; the support platform being part of a base structure, which is also provided with a raised work platform;

hinging the telescopic antenna to the work platform by two fixing eyelets which are arranged at the lower ends of the telescopic antenna; and lifting the telescopic antenna from a transport position, in which the telescopic antenna is positioned on transport means with the two fixing eyelets at a level which is lower than the level of the work platform, to a working position, in which the telescopic antenna is vertically arranged on the work platform with the fixing eyelets hinged to the work platform;

wherein the lifting stage takes place while maintaining a longitudinal axis of the upper portion of the telescopic antenna parallel to a longitudinal axis of the lower portion of the telescopic antenna and parallel to the support platform until the telescopic antenna is hinged to the work platform by an articulated structure having at least two rocker arms hinged to the telescopic antenna, and subsequently rotating the telescopic antenna around the fixing eyelets by at least one linear actuator which is interposable between the telescopic antenna and the deck; hinging the at least two rocker arms to the deck to close the articulated structure, and moving the thrust head of the linear actuator before the rotation of the telescopic antenna, wherein the at least one linear actuator oscillates the rockers arms and lifts the telescopic antenna.

8. The method according to claim 7, comprising a lifting stage of the upper portion of the telescopic antenna by a holding trestle mounted on the deck.

9. The method according to claim 8, comprising lifting the work platform to a working position via a connecting position, in correspondence to which the fixing eyelets of the telescopic antenna are connected to the work platform.

10. The method according to claim 9, comprising extending the telescopic antenna which is vertically arranged by a lifting cylinder arranged inside the antenna.

11. The method according to claim 7, wherein the lifting stage comprises a first step wherein the telescopic antenna is lifted to a raised horizontally extending position and a second step wherein the telescopic antenna is rotated from raised horizontally extending position to a vertically extending position.

12. The method according to claim 11, wherein the second step occurs with the fixing eyelets hinged to the work platform.

* * * * *